US011221586B2

(12) United States Patent
Aono et al.

(10) Patent No.: US 11,221,586 B2
(45) Date of Patent: Jan. 11, 2022

(54) IMAGE FORMING APPARATUS

(71) Applicant: CANON KABUSHIKI KAISHA, Tokyo (JP)

(72) Inventors: Kazuhiko Aono, Numazu (JP); Kenji Takagi, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/010,617

(22) Filed: Sep. 2, 2020

(65) Prior Publication Data

US 2021/0096507 A1 Apr. 1, 2021

(30) Foreign Application Priority Data

Sep. 26, 2019 (JP) ..... JP2019-175899

(51) Int. Cl.
*G03G 21/20* (2006.01)
*G03G 15/00* (2006.01)

(52) U.S. Cl.
CPC ..... *G03G 21/206* (2013.01); *G03G 15/6573* (2013.01)

(58) Field of Classification Search
CPC ..... G03G 21/206
See application file for complete search history.

(56) References Cited

U.S. PATENT DOCUMENTS

2015/0147103 A1* 5/2015 Kubo ..... G03G 21/206 399/405
2018/0052417 A1* 2/2018 Maruyama ..... G03G 15/6573
2018/0088499 A1* 3/2018 Inada ..... G03G 15/5041
2018/0284691 A1* 10/2018 Shige ..... G03G 21/206

FOREIGN PATENT DOCUMENTS

JP 2010-21033 A 8/2011
JP 2014-80081 A 11/2015

* cited by examiner

*Primary Examiner* — Sevan A Aydin
(74) *Attorney, Agent, or Firm* — Canon U.S.A., Inc. I.P. Division

(57) ABSTRACT

An image forming apparatus includes an image forming unit configured to form a toner image on one surface of a recording material, a fixing unit configured to fix the toner image on the surface of the recording material in a nip portion formed by a heating unit and a pressing unit, a discharge unit configured to discharge the recording material on which the toner image has been fixed to a discharge tray, and a recording material conveyance path between the fixing unit and the discharge unit. In a conveyance direction of the recording material from the fixing unit to the discharge unit, a fan is disposed between the fixing unit and the discharge unit. The fan takes in air from an intake portion that takes in air of the recording material conveyance path and exhausts air such that air is applied to the recording material discharged from the discharge unit.

8 Claims, 4 Drawing Sheets

IMAGE FORMING APPARATUS

BACKGROUND

Field of the Disclosure

The present disclosure relates to an electrophotographic image forming apparatus, such as a copying machine and a laser beam printer, that forms a toner image by using an image bearing member.

Description of the Related Art

An image forming operation performed by an image forming apparatus using toner generally includes the following known operations. First, an exposure unit that performs exposure based on image information forms an electrostatic latent image on a uniformly charged photosensitive member, and a developing unit develops the electrostatic latent image to form a toner image. The toner image is then transferred to a recording material, and a fixing unit applies heat and pressure to the recording material to fix the toner image on the recording material. The recording material on which the toner image has been fixed passes a discharge conveyance unit disposed downstream from the fixing unit, and is guided to a discharge unit. The recording material is then discharged to a discharge stacking unit disposed outside an image forming apparatus body.

In the image forming operation, a temperature of the discharge conveyance unit is increased by the heated recording material. With a high temperature of the discharge conveyance unit, a component of the image forming apparatus may be thermally expanded or deformed, which may change a contact state between the component and the recording material. Thus, there is concern for the occurrence of a conveyance failure. Moreover, an elevated temperature of the discharge conveyance unit may keep the recording material at a high temperature, and thus, toner on the recording material may not be completely solidified and may have stickiness. Thus, there is concern that recording materials stacked on the discharge stacking unit may stick to each other. On this account, the recording material having a high temperature needs to be cooled.

Japanese Patent Application No. 2014-80081 discusses a method in which an airflow for blowing air to a discharge conveyance unit is formed to cool the discharge conveyance unit, as one of the methods for addressing the issues described above. In addition, Japanese Patent Application No. 2010-21033 discusses a method in which an intake duct is disposed in an upper portion of a discharge conveyance unit to release heat to the outside.

SUMMARY

Recent image forming apparatuses are expected to have higher productivity and smaller size, and thus a quantity of heat needed by a fixing unit and a temperature of a recording material tend to increase. Accordingly, while the cooling of the recording medium has become more important, an increase in an apparatus size needs to be prevented.

An aspect of the present disclosure includes the following. An image forming apparatus includes an image forming unit configured to form a toner image on one surface of a recording material, a fixing unit configured to fix the toner image on the one surface of the recording material in a nip portion formed by a heating unit and a pressing unit, a discharge unit configured to discharge the recording material on which the toner image has been fixed to a discharge tray, and a recording material conveyance path disposed between the fixing unit and the discharge unit. In a conveyance direction of the recording material from the fixing unit to the discharge unit, a fan is disposed between the fixing unit and the discharge unit. The fan takes in air from an intake portion configured to take in air of the recording material conveyance path and exhausts air such that air is applied to the recording material which is discharged from the discharge unit.

Further features of the present disclosure will become apparent from the following description of exemplary embodiments with reference to the attached drawings.

DESCRIPTION OF THE EMBODIMENTS

Figure 1:
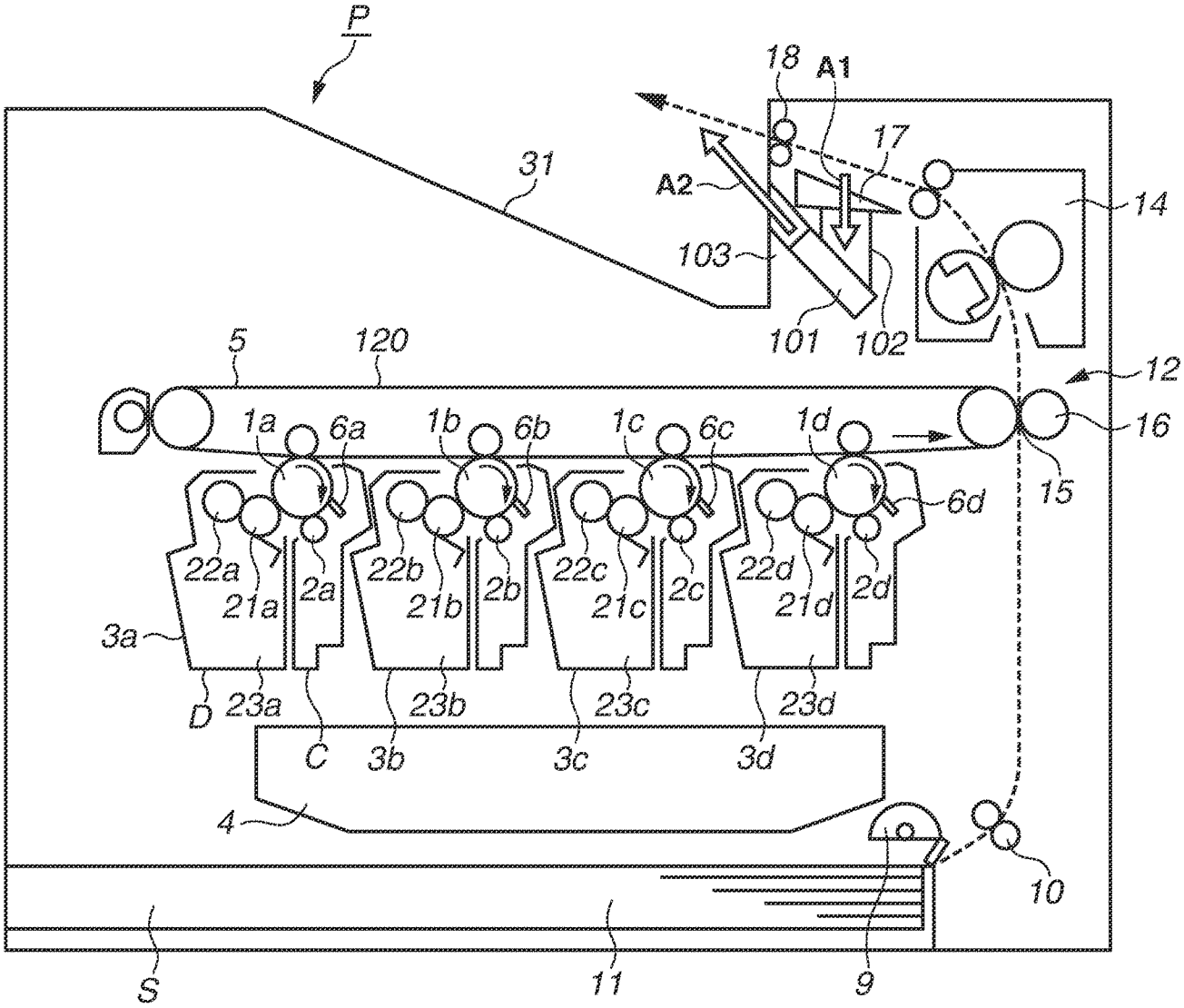
FIG. 1 is a sectional view illustrating an image forming apparatus according to a first exemplary embodiment.
Figure 2:
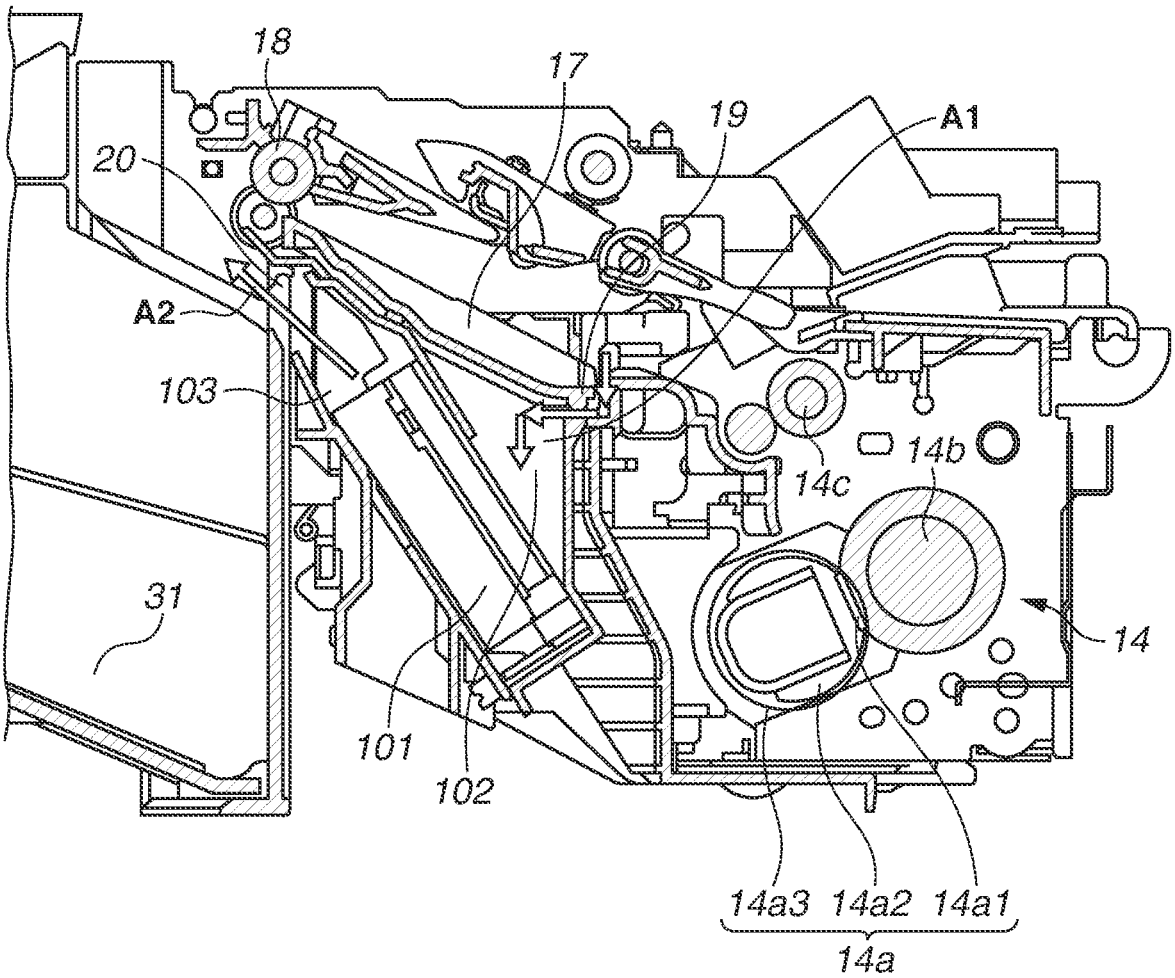
FIG. 2 is a sectional view illustrating a fixing unit and surroundings of the fixing unit according to the first exemplary embodiment.

A first exemplary embodiment of the present disclosure will be described below. FIG. 1 is a main sectional view illustrating an overall configuration of an image forming apparatus P, and FIG. 2 is a sectional view illustrating a fixing unit and its surroundings according to the present exemplary embodiment. The present exemplary embodiment will be described below with reference to FIGS. 1 and 2. While a full-color laser beam printer including a plurality of photosensitive drums will be described in the present exemplary embodiment, the present exemplary embodiment is applicable to a monochrome printing apparatus or a printer including a single photosensitive drum.

The image forming apparatus P includes an image forming unit 12 that forms a toner image, and a fixing device (the fixing unit) 14 serving as fixing means for fixing the toner image on a recording material S.

The image forming unit 12 includes four process cartridges 3 (3*a*, 3*b*, 3*c*, and 3*d*), a laser scanner 4 serving as an optical unit, and a transfer unit 5. Each of the process cartridges 3 (3*a* to 3*d*) includes process units that act on a photosensitive drum 1 serving as an image bearing member and are integrally formed as a cartridge. Each of the process cartridges 3 (3*a* through 3*d*) is attachable to and detachable from the color laser printer serving as the image forming apparatus P. These four process cartridges 3*a*, 3*b*, 3*c*, and 3*d* have the same configurations. However, the process cartridges 3*a*, 3*b*, 3*c*, and 3*d* differ from one another in toner color to be used for image formation, that is, toners of yellow (Y), magenta (M), cyan (C), and black (Bk). Hereinafter, suffixes a though d will be omitted in description of the configuration common to each color. For example, the process cartridges 3*a*, 3*b*, 3*c*, and 3*d* are collectively referred to as a process cartridge 3 that represents each of the process cartridges 3*a*, 3*b*, 3*c*, and 3*d*. The process cartridge 3 includes a development unit D and a cleaner unit C. The development unit D includes a developing roller 21, a developer applying roller 22, and a toner container 23. The cleaner unit C includes the photosensitive drum 1 serving as an image bearing member, a charging roller serving as a charging unit 2, and a cleaning blade serving as a cleaning unit 6.

On the periphery of the photosensitive drum 1, the charging unit 2, the developing roller 21 as a developing unit, the transfer unit 5, and the cleaning unit 6 are arranged in order along the rotation direction of the photosensitive drum 1. Both end portions of the photosensitive drum 1 are rotatably supported by flanges, and one of the end portions receives a driving force transmitted from a drive motor (not illustrated), so that the photosensitive drum 1 is rotated in the clockwise direction indicated by an arrow illustrated in FIG. 1.

The charging unit 2 which is a roller-shaped conductive roller uniformly charges the surface of the photosensitive drum 1 by a power source (not illustrated) applying a charging bias voltage thereto while being brought into contact with the surface of the photosensitive drum 1. The laser scanner 4 is disposed vertically below the process cartridge 3, and irradiates the photosensitive drum 1 with light based on an image signal.

The development units D include respective toner containers in which respective colors of yellow, magenta, cyan, and black toners are stored. The development unit D further includes the developing roller 21 disposed adjacent to the surface of the photosensitive drum 1. The developing roller 21 is driven to rotate by a drive unit (not illustrated), and performs development by a developing bias power source (not illustrated) applying a developing bias voltage.

An intermediate transfer unit serving as the transfer unit 5 includes an intermediate transfer belt 120 that is tightly stretched by a drive roller and a tension roller and to which tension is applied by the tension roller. The intermediate transfer unit further includes primary transfer rollers that are disposed on an inner side of the intermediate transfer belt 120 and face the respective photosensitive drums 1*a*, 1*b*, 1*c*, and 1*d*. A bias applying unit (not illustrated) applies a transfer bias to the primary transfer rollers. A positive-polarity bias is applied to each of the primary transfer rollers, so that toner images on the photosensitive drums 1 are primarily transferred to the intermediate transfer belt 120 in sequential order from the toner image on the photosensitive drum 1*a*. A toner image on which the toner images of four colors overlap on the intermediate transfer belt 120 is conveyed to a secondary transfer unit 15.

A feeding device includes a feed roller 9 that feeds a recording material S, such as paper, from a sheet feed tray 11 in which recording materials S are stored, and a conveyance roller pair 10 that conveys the fed recording material S. The sheet feed tray 11 can be pulled out in the left direction (a front direction of an apparatus body) in FIG. 1. After a user pulls out the sheet feed tray 11 to remove the sheet feed tray 11 from the apparatus body, the user can set recording materials S in the sheet feed tray 11 and insert the sheet feed tray 11 into the apparatus body. In this way, the user can replenish the recording materials S. The recording materials S stored in the sheet feed tray 11 are pressed by the feed roller 9, and separated one by one by a separation pad. Then, the separated recording material S is conveyed.

In the secondary transfer unit 15, a positive-polarity bias is applied to a secondary transfer roller 16, so that the four-color toner image on the intermediate transfer belt 120 is secondarily transferred to the conveyed recording material S.

As illustrated in FIG. 2, the fixing device 14 serving as a fixing unit includes a heating unit 14*a* that heats a recording material S and a pressing roller (a nip forming member, a pressing unit) 14*b* that presses the recording material S against the heating unit 14*a* such that a nip portion that nips and conveys the recording material S is formed. In addition, the fixing device 14 includes a conveyance roller 14*c* that conveys the recording material S having passed through the nip portion to the outside from the fixing device 14. The heating unit 14*a* includes a heater 14*a*1 elongated in the direction orthogonal to a conveyance direction of the recording material S, a heater holder 14*a*2 that supports the heater 14*a*1, and an endless film 14*a*3 that rotates around the heater 14*a*1 supported by the heater holder 14*a*2. The heating unit 14*a* heats the toner image transferred onto the recording material S by using the heater 14*a*1 via the film 14*a*3 rotating around the heater 14*a*1 and the heater holder 14*a*2 while a pressure is being applied to the nip portion formed with the pressing unit 14*b*. In this way, heat and pressure are applied to the image formed on the recording material S at the nip portion, and the image is fixed on the recording material S. Subsequently, the recording material S on which the image has been fixed is discharged from the fixing device 14 via the conveyance roller 14*c*. The recording material S on which the image has been fixed passes through a recording material conveyance path provided between the fixing device 14 and a discharge roller pair 18, and is discharged to a discharge tray 31 by the discharge roller pair 18 (a discharge unit). Thus, image formation on the recording material S is completed.

(Configuration for Cooling Recording Material S)

A configuration for cooling a recording material S will be described below with reference to FIG. 2. FIG. 2 is a sectional view illustrating the fixing device 14 serving as a fixing unit according to the first exemplary embodiment and its surroundings.

In typical image forming apparatuses, the heat given off from the recording material S on which an image has been fixed by a fixing device stays in the surroundings of the fixing device (a conveyance roller), and is accumulated more as the toner image fixing is performed. As a result, an internal temperature of the image forming apparatus increases, which may cause a thermal expansion or a deformation of a component of the image forming apparatus. This may change a contact state between the component and a recording material, resulting in the occurrence of a conveyance failure.

To address this, a fan 101 is disposed between the discharge tray 31 and the fixing device 14, and air generated by the fan 101 is applied to a recording material S discharged by the discharge roller pair 18 according the present exemplary embodiment. More specifically, in the conveyance direction of the recording material S between the fixing device 14 and the discharge roller pair 18, the recording material conveyance path is provided between the fixing device 14 and the discharge roller pair 18 including a guide member 17 facing one surface of the recording material S on which the toner image has been transferred and fixed. The guide member 17 extends in the direction orthogonal to the conveyance direction of the recording material S (in the axial direction of the photosensitive drum 1), and is longer than the recording material S. A space 19 extending in the direction orthogonal to the conveyance direction of the recording material S is formed between the fixing device 14 and the guide member 17.

In the present embodiment, a sirocco fan with rotary blades accommodated in a scroll casing is used as the fan 101. In a case where the sirocco fan is used as the fan 101, the space 19 and at least one portion of the fan 101 are preferably arranged to face each other in the rotational axis direction of the rotary blades of the sirocco fan. In the sirocco fan, an air intake direction and an air exhaust direction are orthogonal to each other. Accordingly, the fan 101 and at least one portion of the discharge roller pair 18 are preferably arranged to face each other in the direction orthogonal to the rotational axis direction of the rotary blades of the sirocco fan. This configuration enhances an air intake and exhaust efficiency of the fan 101 without changing the direction of air by an intake duct 102 and an exhaust duct 103.

In the present exemplary embodiment, the fan 101 takes in air of the recording material conveyance path from the space 19 serving as an intake portion via the intake duct 102, and generates air that flows in a direction A1 illustrated in FIG. 2. According to the present exemplary embodiment, the fan 101 takes in air from the space 19 at a position facing one surface of the recording material S on which an image is fixed in the recording material conveyance path. This facilitates exhaustion of heat giving off from the recording material S, and thus the heat is prevented from staying in the surroundings of the conveyance roller 14*c* of the fixing device 14. As a result, an ambient temperature in the surroundings of the conveyance roller 14*c* and an internal temperature of the image forming apparatus P can be prevented from rising, and a failure caused by the internal temperature rise of the image forming apparatus P can be prevented.

Moreover, in the present exemplary embodiment, the fan 101 is configured such that air is exhausted from an exhaust port (an exhaust portion) 20 disposed vertically below the discharge roller pair 18 via the exhaust duct 103, and air flowing in the direction A2 illustrated in FIG. 2 is applied to the recording material S to be discharged from the discharge roller pair 18. In this way, the recording material S is cooled by air exhausted from the exhaust port 20, and the toner on the recording material S is completely solidified in a more reliable manner. Thus, discharged recording materials S are prevented from sticking to each other in the discharge tray 31. In the present exemplary embodiment, air taken in from the space 19 between the fixing device 14 and the guide member 17 is applied to the recording material S to be discharged from the discharge roller pair 18. As long as heat given off from the recording material S does not stay or is not accumulated in the surroundings of the conveyance roller 14*c*, an ambient temperature in the surroundings of the conveyance roller 14*c* is sufficiently lower than a temperature of the recording material S to be discharged from the discharge roller pair 18. Moreover, since air that passes the surroundings of the heater 14*a*1 of the fixing device 14 is not configured to be actively taken in, the air taken in from the space 19 can sufficiently cool the recording material S.

Here, in the fixing device 14 according to the present exemplary embodiment, one surface of the recording material S on which a toner image has been transferred by the secondary transfer unit 15 is brought into contact with the heating unit 14*a* (the film 14*a*3) of the fixing device 14 and is heated so that toner on the recording material S is reliably fixed with a small quantity of heat. Thus, on the recording material S having undergone the fixing, not only the toner image but also the one surface of the recording material S on which the toner image has been fixed have high temperatures. Thus, air exhausted from the exhaust port 20 is directly applied to the toner image and the one surface of the recording material S. Such a configuration enables the recording material S to be further cooled.

In the present exemplary embodiment, the fan 101 is disposed between the guide member 17 and the image forming unit 12 (the transfer unit 5) in the vertical direction and between the fixing device 14 and the discharge roller pair 18 in the conveyance direction of the recording material S. Such an arrangement can reduce the length of the intake duct 102 from the space 19 between the fixing device 14 and the guide member 17 to the fan 101, and the length of the exhaust duct 103 from the fan 101 to the exhaust port 20. As a result, an increase in size of the image forming apparatus P can be prevented.

Shapes and relative arrangements of components described in the exemplary embodiment can be changed appropriately depending on various conditions and a configuration of an apparatus to which the present disclosure is applied. That is, the scope of the present disclosure is not limited to the exemplary embodiment.

Figure 3:
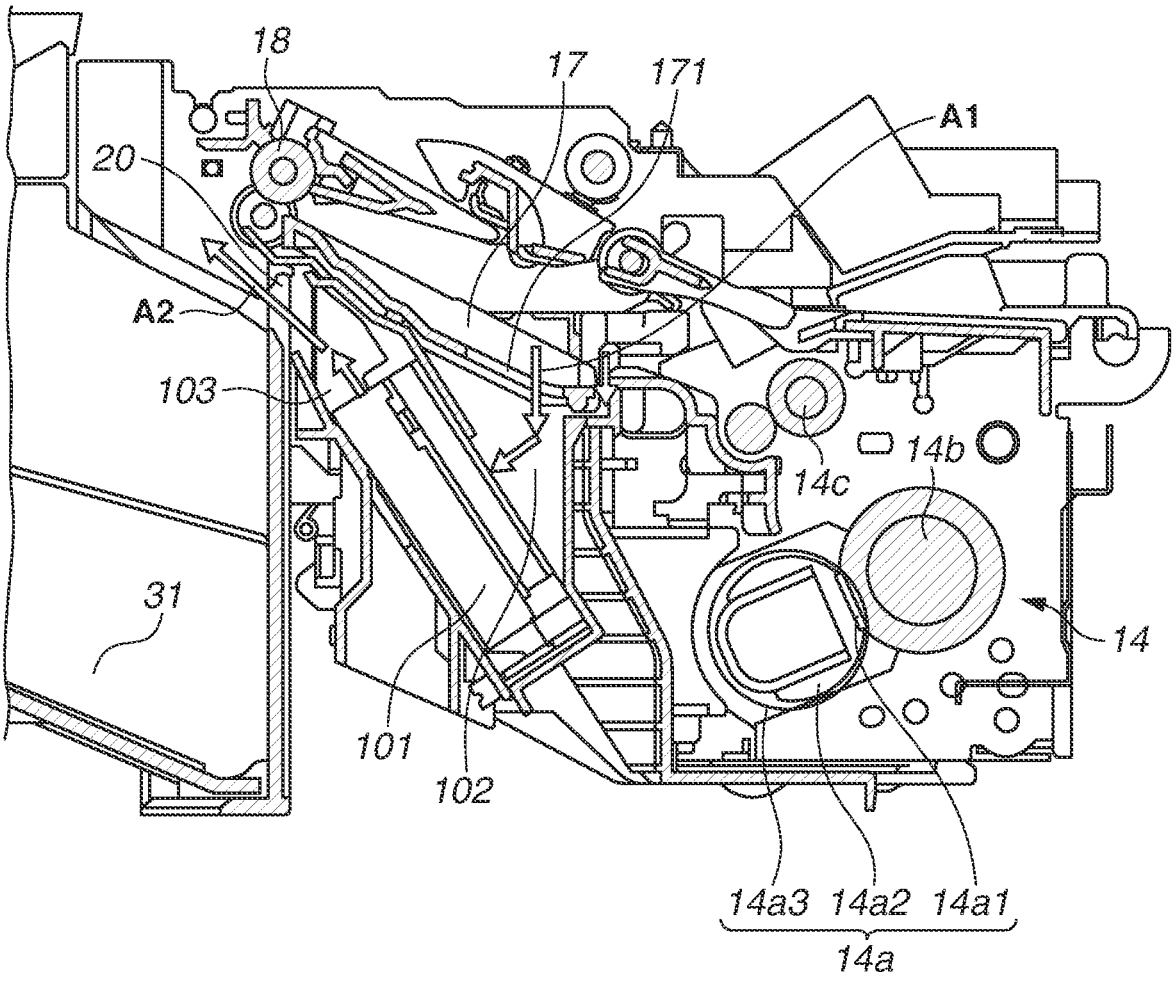
FIG. 3 is a sectional view illustrating a fixing unit and the surroundings of the fixing unit according to a first modification example.

The configuration is described in which air is taken in from the space 19 between the fixing device 14 and the guide member 17 as an example in the exemplary embodiment, but this is not restrictive. As illustrated in a first modification example in FIG. 3, a guide member 17 may have a ventilation area 171 that has an opening corresponding to an intake portion arranged at a position facing one surface of a recording material S to be subjected to the fixing in the recording material conveyance path. The ventilation area 171 is an area in which one or a plurality of openings, that is, holes, is formed. In the first modification example, the ventilation area 171 has a plurality of holes linearly arranged in the direction orthogonal to the conveyance direction of the recording material S. In the direction orthogonal to the conveyance direction of the recording material S, the ventilation area 171 is longer than a recording material S having a maximum image formable size. When such a recording material S passes the space 19, both ends of the ventilation area 171 are not covered with the recording material S as seen from a direction vertically above. If a sirocco fan is used as a fan 101, the ventilation area 171 and at least one portion of the fan 101 are to be arranged to face each other in the rotational axis direction of rotary blades of the sirocco fan. In the sirocco fan, the air intake direction and the air exhaust direction are perpendicular to each other. Accordingly, the fan 101 and at least one portion of the discharge roller pair 18 are to be arranged to face each other in the direction orthogonal to the rotational axis direction of the rotary blades of the sirocco fan. Thus, an air intake and exhaust efficiency of the fan 101 can be enhanced not only without unnecessarily increasing lengths of the intake duct 102 and the exhaust duct 103, but also without changing the direction of air by the intake duct 102 or the exhaust duct 103.

Figure 4:
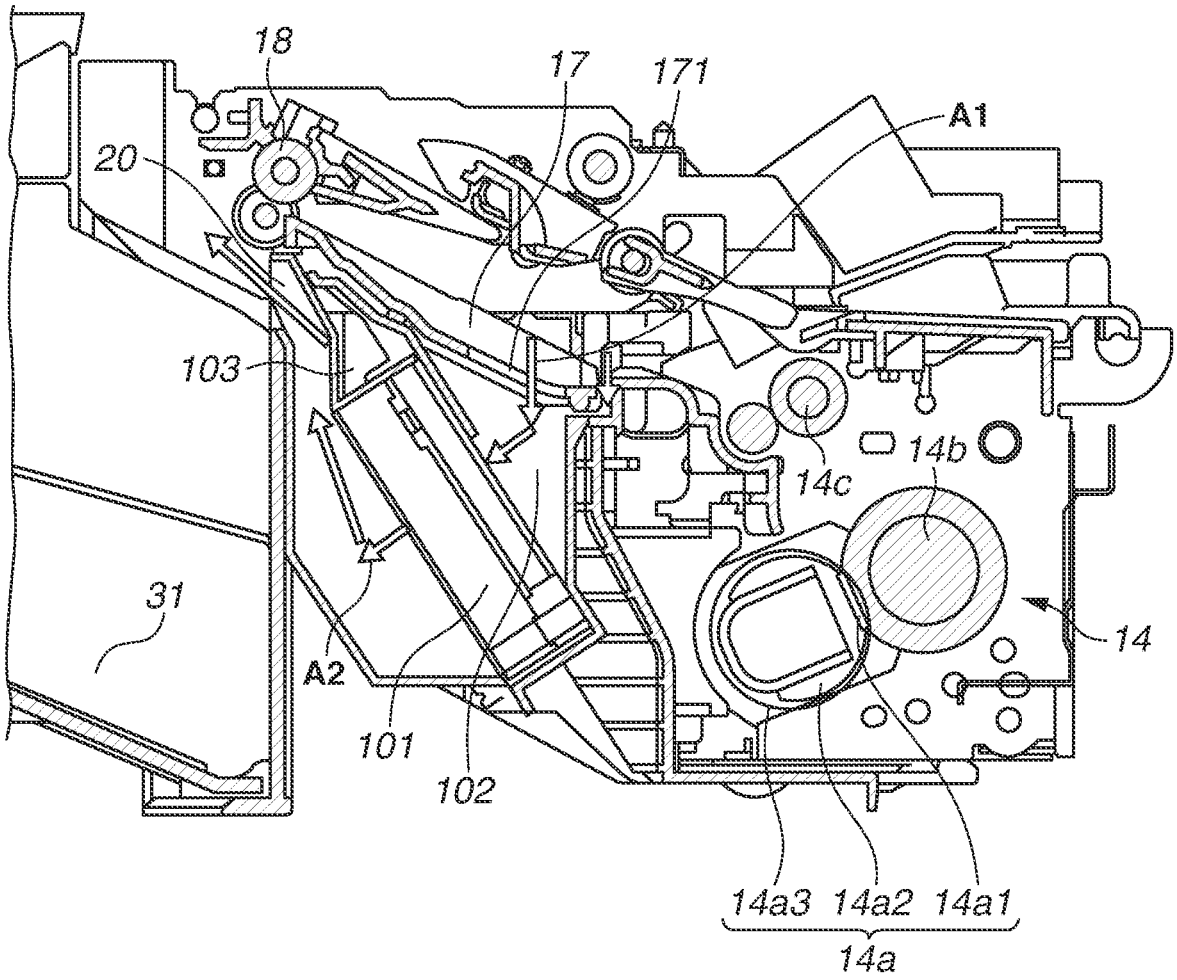
FIG. 4 is a sectional view illustrating a fixing unit and the surroundings of the fixing unit according to a second modification example.

Alternatively, an axial fan as illustrated in a second modification example in FIG. 4 can be used as the fan 101, instead of the sirocco fan described in the first modification example. If the axial fan is used as the fan 101, the ventilation area 171 and at least one portion of the fan 101 are to be arranged to face each other in the rotational axis direction of rotary blades of the axial fan. Thus, an air intake and exhaust efficiency of the fan 101 can be enhanced without changing the direction of air by the intake duct 102. In the axial fan, an air intake direction and an air exhaust direction are substantially the same directions. Accordingly, if the axial fun is used as the fan 101, the direction of air is changed by the exhaust duct 103 heading for an exhaust port 20 to apply air to a recording material S to be discharged from a discharge roller pair 18. While if the axial fun is used as the fan 101, the exhaust duct 103 is larger than that if the sirocco fan is used as the fan 101, the use of the axial fun can increase air volume.

Various changes are possible within the scope of the disclosure, as described above.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2019-175899, filed Sep. 26, 2019, which is hereby incorporated by reference herein in its entirety.

What is claimed is:

1. An image forming apparatus comprising:

an image forming unit configured to form a toner image on one surface of a recording material;

a fixing unit configured to fix the toner image on the one surface of the recording material in a nip portion formed by a heating unit and a pressing unit;

a discharge unit configured to discharge the recording material on which the toner image has been fixed to a discharge tray;

a fan configured to create a flow of air, wherein at least a portion of the fan is positioned higher than the fixing unit and lower than the discharge unit in a vertical direction; and a recording material conveyance guide disposed between the fixing unit and the discharge unit and configured to guide the recording material, wherein the fan takes in air from an intake portion configured to take in air of the recording material conveyance guide and exhausts air such that air is applied to the recording material which is discharged from the discharge unit.

2. The image forming apparatus according to claim 1, wherein the fan applies air to the one surface of the recording material on which the toner image has been formed to cool the one surface of the recording material.

3. The image forming apparatus according to claim 2, wherein, in the nip portion, the fixing unit brings the heating unit into contact with the one surface of the recording material on which the toner image has been formed.

4. The image forming apparatus according to claim 1, wherein, in the recording material conveyance guide, the intake portion is disposed at a position facing the one surface of the recording material on which the toner image has been formed.

5. The image forming apparatus according to claim 1, wherein the intake portion is a hole arranged in the recording material conveyance guide.

6. The image forming apparatus according to claim 1, wherein the fan is a sirocco fan.

7. The image forming apparatus according to claim 1, wherein the fan takes in air, through the intake portion, in a direction of moving away from the recording material conveyance guide and exhausts air having been taken in toward the recording material which is discharged from the discharge unit.

8. The image forming apparatus according to claim 1, further comprising an exhaust portion configured to exhaust air having been taken in toward the recording material which is discharged from the discharge unit, wherein the exhaust portion is positioned lower than the discharge unit in a vertical direction.

* * * * *